US010854142B2

(12) United States Patent
Koshihara

(10) Patent No.: US 10,854,142 B2
(45) Date of Patent: Dec. 1, 2020

(54) DISPLAY DEVICE AND ELECTRONIC APPARATUS

(71) Applicant: SEIKO EPSON CORPORATION, Tokyo (JP)

(72) Inventor: Takeshi Koshihara, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/739,269

(22) Filed: Jan. 10, 2020

(65) Prior Publication Data

US 2020/0226979 A1 Jul. 16, 2020

(30) Foreign Application Priority Data

Jan. 11, 2019 (JP) ..... 2019-003202

(51) Int. Cl.
*G09G 3/3258* (2016.01)
*G09G 3/3275* (2016.01)

(52) U.S. Cl.
CPC ..... *G09G 3/3258* (2013.01); *G09G 3/3275* (2013.01); *G09G 2300/08* (2013.01); *G09G 2310/0251* (2013.01); *G09G 2320/041* (2013.01)

(58) Field of Classification Search
None
See application file for complete search history.

(56) References Cited

U.S. PATENT DOCUMENTS

2003/0030602 A1* 2/2003 Kasai ..... G09G 3/325 345/76
2004/0090434 A1* 5/2004 Miyazawa ..... G09G 3/3241 345/204
2013/0120338 A1* 5/2013 Kubota ..... G09G 3/3208 345/211
2017/0372658 A1 12/2017 Tamura

FOREIGN PATENT DOCUMENTS

JP 2018-004720 A 1/2018

* cited by examiner

*Primary Examiner* — Nicholas J Lee
(74) *Attorney, Agent, or Firm* — JCIPRNET

(57) ABSTRACT

A display device includes a pixel circuit, a driving circuit configured to drive a data line coupled to the pixel circuit, and a first capacitance element provided between the data line and the driving circuit, wherein the driving circuit includes a second capacitance element, and a first switching circuit configured to alternately repeat charging and discharging of the second capacitance element, and is configured to control the charging and the discharging based on a gradation specified by the pixel circuit, and output a voltage signal corresponding to the gradation.

7 Claims, 14 Drawing Sheets

DISPLAY DEVICE AND ELECTRONIC APPARATUS

The present application is based on, and claims priority from JP Application Serial Number 2019-003202, filed Jan. 11, 2019, the disclosure of which is hereby incorporated by reference herein in its entirety.

BACKGROUND

1. Technical Field

The present disclosure relates to a display device and an electronic apparatus.

2. Related Art

In a display device that expresses a pixel using an organic EL element, a liquid crystal element, or the like, as a light-emitting device, data specifying a gradation of the pixel is converted into an analog signal by a D/A converter circuit, and the analog signal is amplified by an amplifier circuit, to drive a data line, in general. The display device is required to consume low power, but in the D/A converter circuit or the amplifier circuit, a current flows constantly through the circuit itself, which makes it difficult to reduce power consumption.

Thus, a technique has been proposed for controlling a voltage of a data line by applying a constant current for a period corresponding to data specifying a gradation (see, for example, JP-A-2018-4720).

However, with the above technique, a driving capability of a transistor for generating the constant current is susceptible to temperature, and thus there is a problem in that voltage accuracy of the data line is low, and a configuration for compensating for change in temperature is separately required.

SUMMARY

A display device according to an aspect of the present disclosure includes a pixel circuit, a driving circuit configured to drive a data line coupled to the pixel circuit, and a first capacitance element provided between the data line and the driving circuit, wherein the driving circuit includes a second capacitance element, and a first switching circuit configured to alternately repeat charging and discharging of the second capacitance element, and is configured to control the charging and the discharging based on a gradation specified by the pixel circuit, and output a voltage signal corresponding to the gradation.

BRIEF DESCRIPTION OF THE DRAWINGS

FIG. 7 is a diagram illustrating another configuration of the gradation signal generation circuit and the like.

FIG. 12 is a diagram illustrating another configuration of the gradation signal generation circuit and the like.

FIG. 16 is a diagram illustrating another configuration of the gradation signal generation circuit and the like.

FIG. 17 is a perspective view illustrating an HMD using the display device according to the exemplary embodiments and the like.

DESCRIPTION OF EXEMPLARY EMBODIMENTS

A display device according to exemplary embodiments of the present disclosure will be described below with reference to the accompanying drawings.

First Exemplary Embodiment

Figure 1:
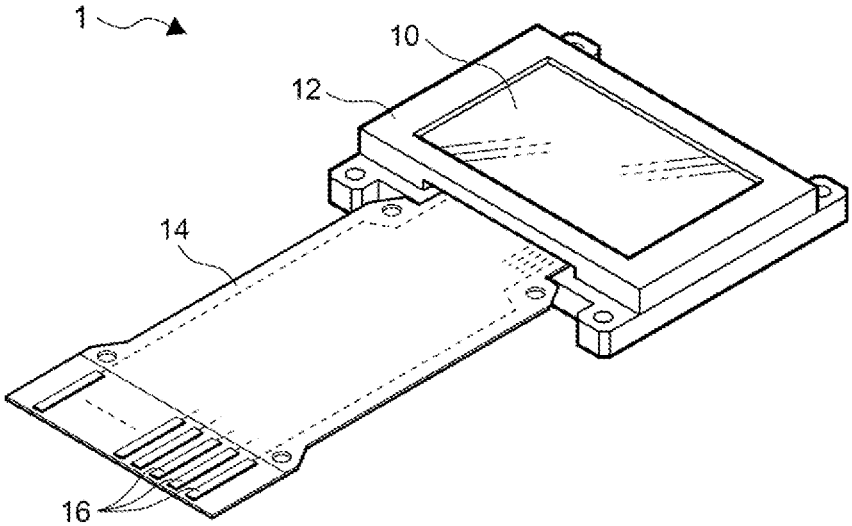
FIG. 1 is a perspective view illustrating a display device according to a first exemplary embodiment.

FIG. 1 is a perspective view illustrating a display device 1 according to a first exemplary embodiment.

The display device 1 illustrated in the figure, for example, includes a micro display 10 that is applied to a head-mounted display and displays an image. The micro display 10 is an organic EL device in which a plurality of pixel circuits, peripheral circuits for driving the pixel circuits, and the like are formed, for example, at a silicon substrate, and the pixel circuit includes an OLED, which is an example of a light-emitting device.

Note that, OLED is an abbreviation for Organic Light Emitting Diode.

The micro display 10 is housed in a frame-shaped case 12 opening at a display unit, and is coupled to one end of an FPC substrate 14. Note that, FPC is an abbreviation for Flexible Printed Circuits.

Another end of the FPC substrate 14 is provided with a plurality of terminals 16, and is to be coupled to a circuit module not illustrated. The circuit module to be coupled to the terminals 16 supplies various electric potentials via the FPC substrate 14, and supplies a video signal together with a synchronization signal.

Figure 2:
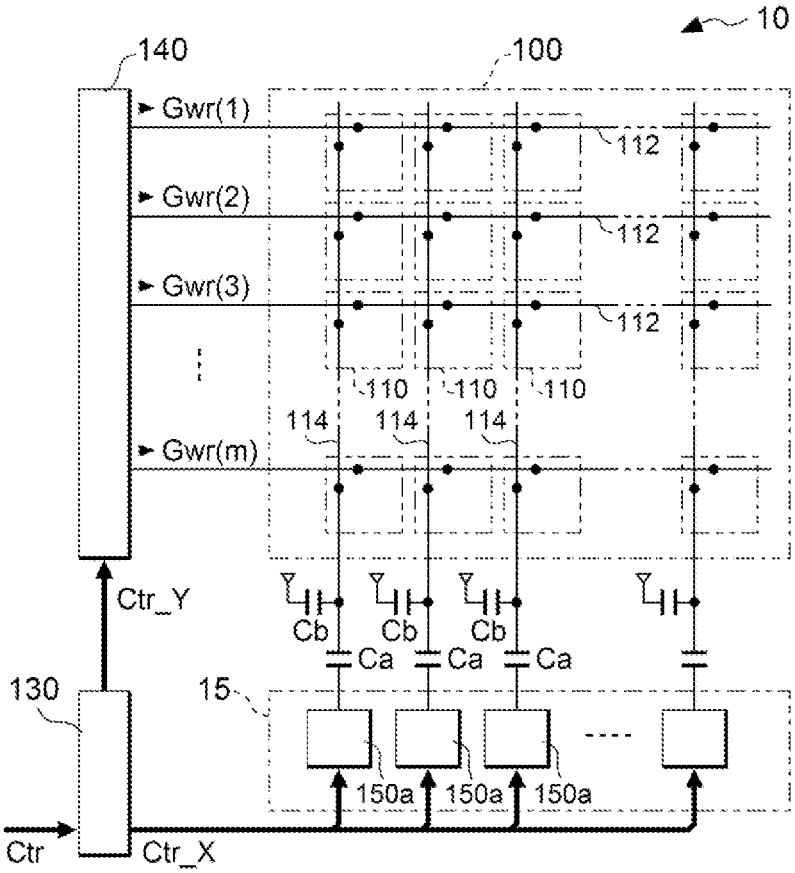
FIG. 2 is a block diagram illustrating an electrical configuration of the display device.

FIG. 2 is a block diagram illustrating an electrical configuration of the micro display 10.

In a display unit 100 of the micro display 10, m rows of scanning lines 112 are provided along a horizontal direction in the figure, and n columns of data lines 114 are provided along a vertical direction in the figure so as to maintain a state of being electrically and mutually insulated from the scanning lines 112. Pixel circuits 110 are arranged in m rows by n columns matrix corresponding to each of intersections of the m rows of scanning lines 112 and the n columns of data lines 114 on the display unit 100.

m and n are integers equal to or greater than 2. In the matrix of the scanning lines 112 and the pixel circuits 110, in order to distinguish the rows from each other for convenience, the respective rows may be referred to as a first, second, third, . . . , and m-th row in order from a top in FIG. 2. When a row is described generally, rather than specifically, i that satisfies $1 \leq i \leq m$ is used to refer to the row as an i-th row.

Similarly, in order to distinguish the columns from each other for convenience in the matrix of the data lines 114 and the pixel circuits 110, the respective columns may be referred to as a first, second, third, . . . , and n-th column in order from a left in FIG. 2. Additionally, when a column is described generally, rather than specifically, i that satisfies $1 \leq j \leq n$ is used to refer to the column as a j-th column.

Note that, in fact, for example, three number of the pixel circuits 110 corresponding to intersections of the scanning line 112 of an identical row and three columns of the data lines 114 adjacent with each other respectively correspond to R (red), G (green), and B (blue) pixels, and these three pixels express one dot of a color image to be displayed. In other words, the present exemplary embodiment is configured to express a color of one dot by additive color mixing by the light-emitting devices of the three pixel circuits 110 of RGB.

A peripheral circuit for driving the pixel circuit 110 is provided around a periphery of the display unit 100. In the present exemplary embodiment, the peripheral circuit includes a control circuit 130, a scanning line drive circuit 140, and a data line drive circuit 15.

Of these, the control circuit 130 generates, based on a video signal and a synchronization signal supplied from a higher device, each of a control signal Ctr_Y for controlling operation of the scanning line drive circuit 140, and a control signal Ctr_X for controlling operation of the data line drive circuit 15.

Note that, the video signal supplied from the higher device specifies a gradation of a pixel to be expressed by the pixel circuits 110 in the m rows by n columns for each frame.

The scanning line drive circuit 140 generates a scanning signal for each row according to the control signal Ctr_Y, and supplies scanning signals Gwr(1), Gwr(2), Gwr(3), . . . , Gwr(m) to the scanning lines 112 in the first, second, third, . . . , m-th rows, in order, respectively. Further, the scanning line drive circuit 140 supplies the scanning signal for each of the rows, and supplies various control signals synchronized with the scanning signal for each of the rows. These control signals will be described later and are omitted in FIG. 2 to avoid complications.

The data line drive circuit 15 includes a gradation signal generation circuit 150*a* corresponding to each of the n columns of data lines 114. A capacitance element Ca is provided between the gradation signal generation circuit 150*a* and the data line 114. Specifically, one end of the capacitance element Ca is coupled to an output end of the gradation signal generation circuit 150*a*, and another end of the capacitance element Ca is coupled to the data line 114.

Note that, the capacitance element Ca is an example of a first capacitance element.

Also, one end of a capacitance element Cb is coupled to the data line 114, and another end of the capacitance element Cb is retained at a constant voltage, for example, a higher side voltage Vdd of a power supply. Note that, the capacitance element Cb may use a capacity parasitic to the data line 114, for example, rather than a capacity provided specifically.

The gradation signal generation circuit 150*a* is a circuit that generates, when one of the scanning lines 112 is selected, a gradation signal having a voltage corresponding to a gradation specified by the pixel circuit 110 corresponding to an intersection of the scanning line 112 and the data line 114 corresponding to the scanning line 112, and supplies to the one end of the capacitance element Ca. Specifically, when the scanning line 112 in the i-th row is selected, the gradation signal generation circuit 150*a* in the j-th column supplies, to the one end of the capacitance element Ca, a gradation signal having a voltage corresponding to a gradation specified by the pixel circuit 110 in the i-th row/j-th column.

Note that, details of the gradation signal generation circuit 150*a* will be described later. In addition, on each of the one end and the other end of the capacitance element Ca, a voltage set circuit for setting a predetermined voltage for each of the ends is provided, but is omitted in FIG. 2 to avoid complications.

Figure 3:
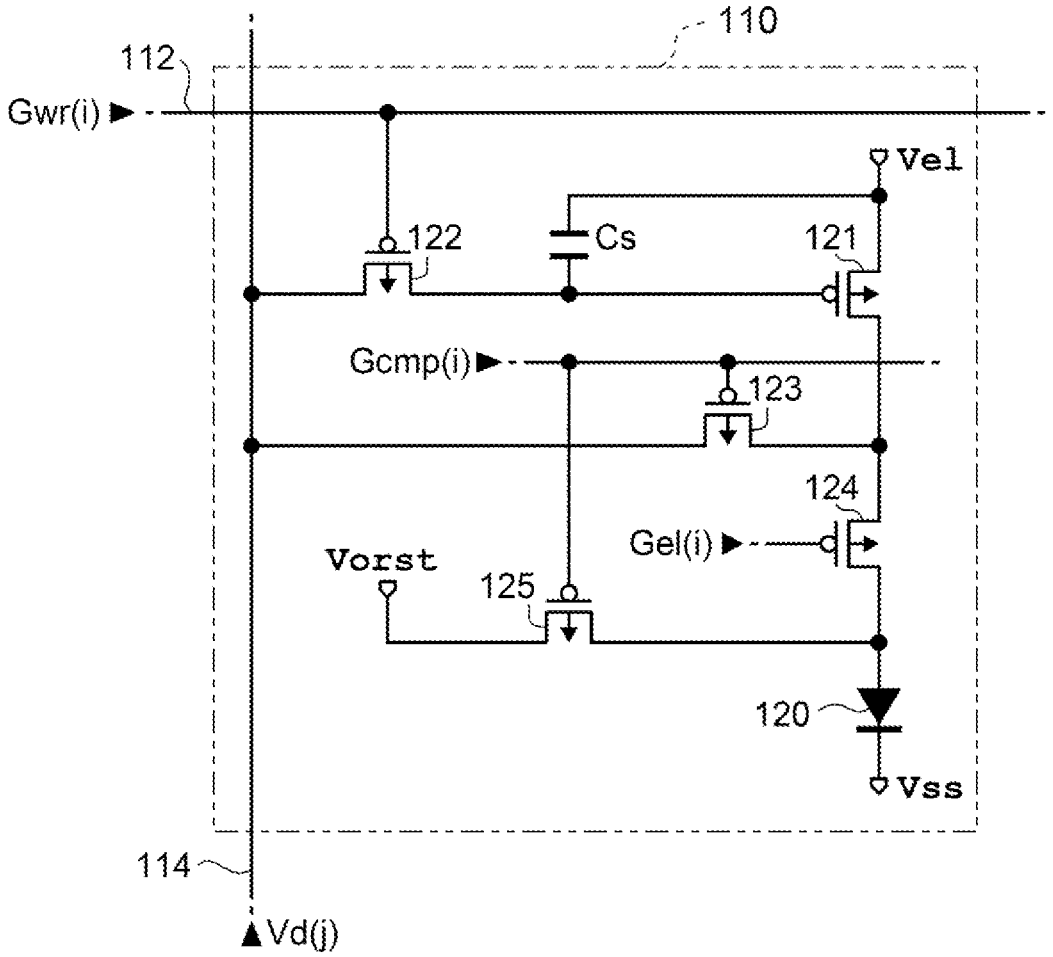
FIG. 3 is a diagram illustrating a configuration of a pixel circuit in the display device.

FIG. 3 is a circuit diagram of the pixel circuit 110. Since the pixel circuits 110 are identical to each other in terms of electrical configuration, here, the pixel circuit 110 positioned at the i-th row/j-th column will be described as a representative.

In the figure, the pixel circuit 110 in the i-th row/j-th column provided corresponding to an intersection of the scanning line 112 in the i-th row and the data line 114 in the j-th column includes an OLED 120, p-channel type transistors 121 to 125, and a capacitance element Cs.

Further, control signals Gel(i) and Gcmp(i), in addition to a scanning signal Gwr(i), are supplied in common to the pixel circuit 110 in the i-th row by the scanning line drive circuit 140 illustrated in FIG. 2.

In the transistor 121 of the pixel circuit 110 in the i-th row/j-th column, a gate node is coupled to a drain node of the transistor 122, a source node is coupled to a power supplying line of a voltage Vel, and a drain node is coupled to a drain node of the transistor 123 and a source node of the transistor 124. Note that, in the capacitance element Cs, one end is coupled to the gate node of the transistor 121, and another end is coupled to the power supplying line of the voltage Vel. Thus, the capacitance element Cs retains a gate voltage in the transistor 121.

In the transistor 122 of the pixel circuit 110 in the i-th row/j-th column, a gate node is coupled to the scanning line 112 in the i-th row, and a source node is coupled to the data line 114 in the j-th column. In the transistor 123 in the pixel circuit 110 in the i-th row/j-th column, the control signal Gcmp(i) is supplied to a gate node, and a source node is coupled to the data line 114 in the j-th column. In the transistor 124 in the pixel circuit 110 in the i-th row/j-th column, the control signal Gel(i) is supplied to a gate node, and a drain node is coupled to an anode of the OLED 120 and a drain node of the transistor 125. In the transistor 125 in the pixel circuit 110 in the i-th row/j-th column, the control signal Gcmp(i) is supplied to a gate node, and a source node is coupled to a power supplying line of a voltage Vorst. Note that, a cathode of the OLED 120 is coupled to a power supplying line of a lower side voltage Vss of the power supply.

Figure 4:
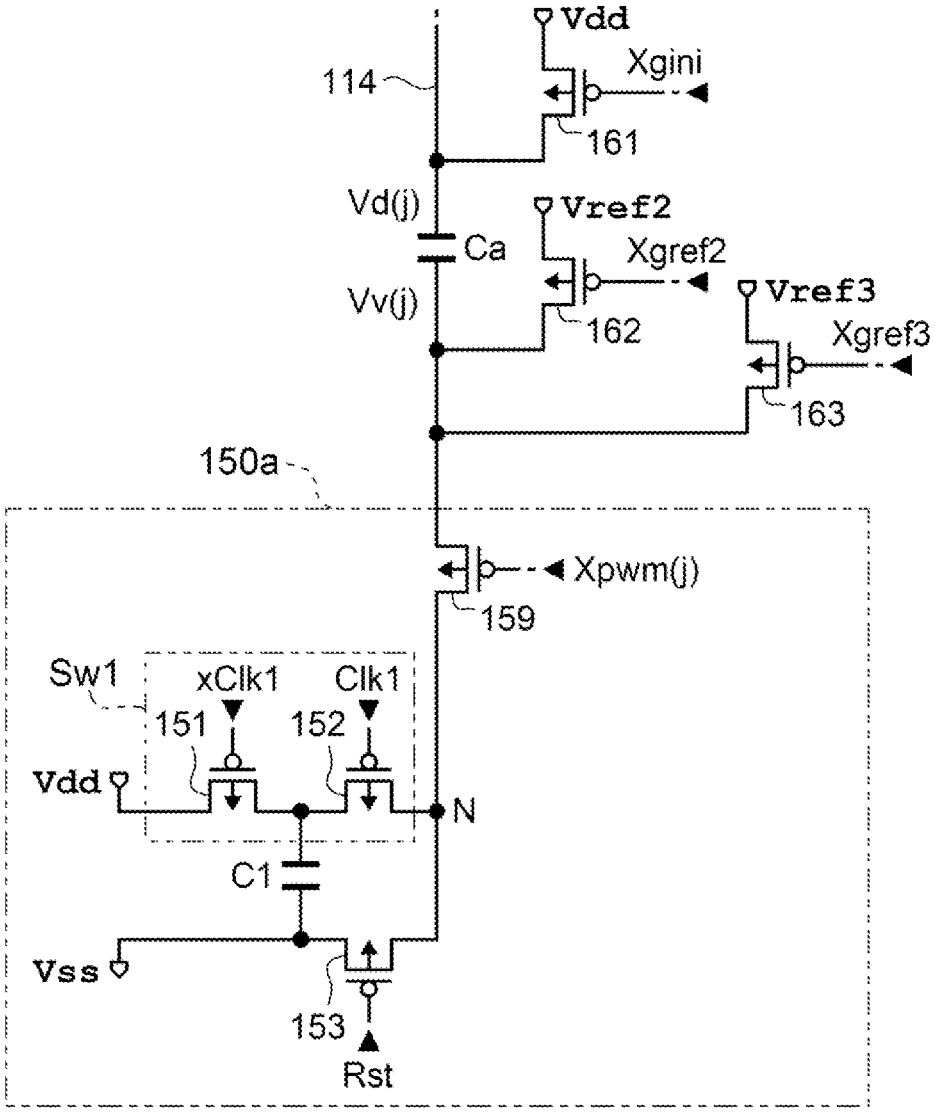
FIG. 4 is a diagram illustrating a configuration of a gradation signal generation circuit and the like in the display device.

FIG. 4 is a circuit diagram illustrating the gradation signal generation circuit 150*a* and the voltage set circuit.

The gradation signal generation circuit 150*a* in the present exemplary embodiment includes a capacitance element C1, a switching circuit Sw1, and p-channel type transistors 153 and 159. Of these, the switching circuit Sw1 includes p-channel type transistors 151 and 152.

Note that, the switching circuit Sw1 is an example of a first switching circuit, and the capacitance element C1 is an example of a second capacitance element.

In the transistor 151, in the switching circuit Sw1, a control signal xClk1 is supplied to a gate node, a source node is coupled to a power supplying line of the voltage Vdd, and a drain node is coupled to one end of the capacitance element C1 and a source node of the transistor 152.

In the transistor 152, a control signal Clk1 is supplied to a gate node, and a drain node is coupled to a source node of the transistor 153 and a source node of the transistor 159. Note that, a point that couples the source node of the transistor 152, a drain node of the transistor 153, and the source node of the transistor 159 is denoted as a node N.

In the transistor 153, a control signal Rst is supplied to a gate node, and the drain node is coupled to another end of the capacitance element C1 and a power supplying line of the voltage Vss.

In the transistor 159, a control signal Xpwm(j) is supplied to a gate node, and a drain node is coupled to one end of the capacitance element Ca. In other words, the drain node of the transistor 159 is the output end of the gradation signal generation circuit 150*a*.

The voltage set circuit includes p-channel type transistors 161 to 163 omitted in FIG. 2.

Specifically, in the transistor 161, a control signal Xgini is supplied to a gate node, a source node is coupled to a power supplying line of the voltage Vdd, and a drain node is coupled to the data line 114, that is, to another end of the capacitance element Ca.

Further, in the transistor 162, a control signal Xgref2 is supplied to a gate node, a source node is coupled to a power supplying line of a voltage Vref2, and a drain node is coupled to the one end of the capacitance element Ca.

In the transistor 163, a control signal Xgref3 is supplied to a gate node, a source node is coupled to a power supplying line of a voltage Vref3, and a drain node is coupled to the one end of the capacitance element Ca.

Note that, a height relationship between the voltages Vref2 and Vref3 is, (Vss<) Vref2<Vref3 (Vdd<Vel), for example.

Thus, in the micro display 10 to be formed at a silicon substrate, not particularly illustrated, but substrate potentials of the transistors 121 to 125 of the pixel circuit 110, the transistors 161 to 163 of the voltage set circuit, and the transistors 151, 152, 153, and 159 of the gradation signal generation circuit 150*a* are all set to the voltage Vel.

The control signals xClk1, Clk1, Rst, Xgini, Xgref2, and Xgref3 are supplied by control circuit 130 in common across the first to n-th columns, but the control signal Xpwm(j) is supplied by control circuit 130 corresponding to the j-th column. That is, although not particularly illustrated, to the first to n-th columns, control signals Xpwm(1) to Xpwm(n) specific to the respective columns are supplied by the control circuit 130.

Note that, the control signals xClk1, Clk1, Rst, Xgini, Xgref2 Xgref3, and Xpwm(1) to Xpwm(n) are included in the control signal Ctr_X. Further, for convenience, a voltage at the one end of the capacitance element Ca in the j-th column, that is, the output end of the gradation signal generation circuit 150*a*, is denoted as Vv(j). In addition, a voltage of the other end of the capacitance element Ca, that is, the data line 114 in the j-th column, is denoted as Vd(j).

Operation

Figure 5:
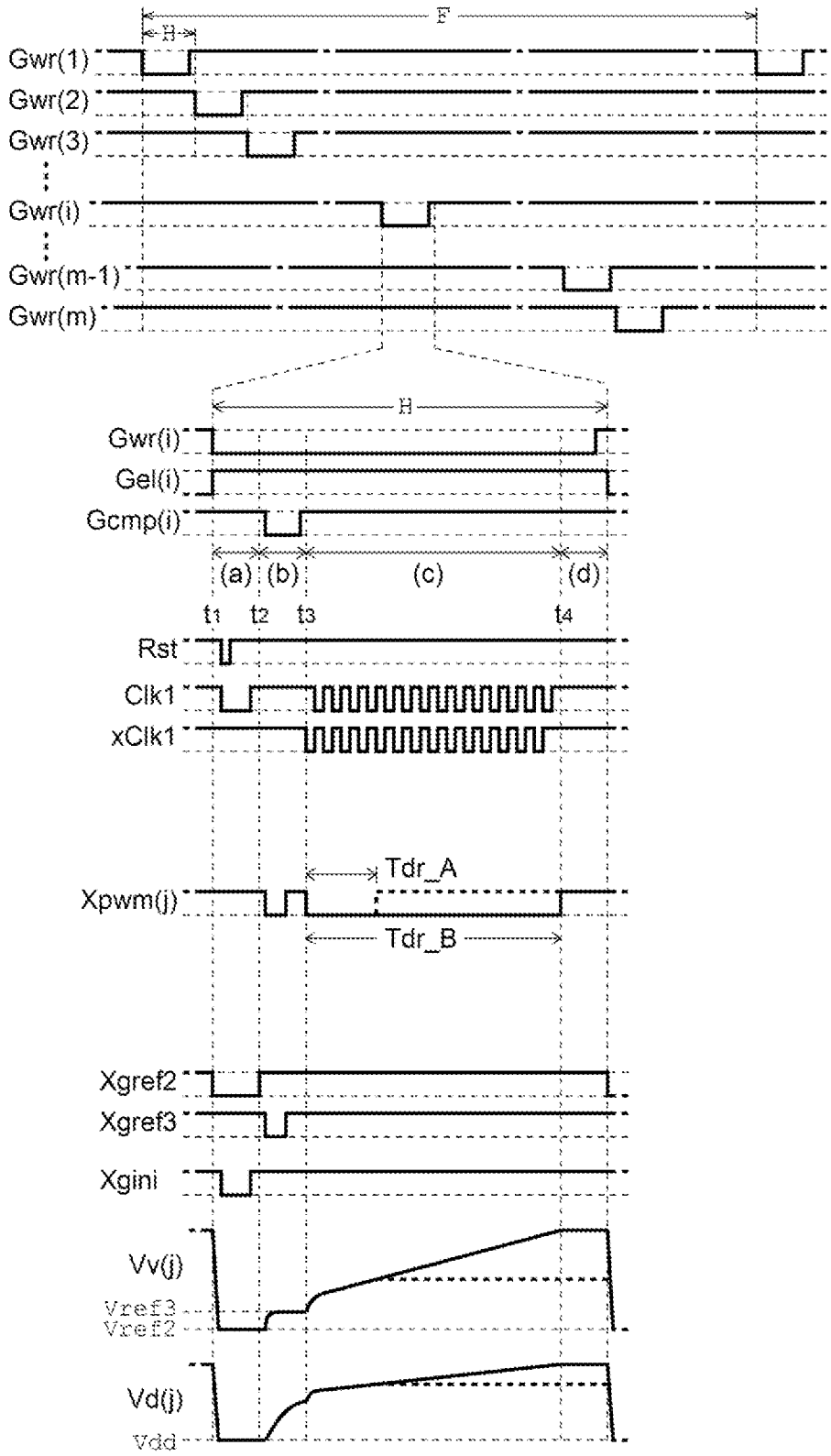
FIG. 5 is a timing chart illustrating operation of the display device.

FIG. 5 is a timing chart illustrating operation of the display device 1 according to the present exemplary embodiment.

In the display device 1, horizontal scanning is performed in an order of first, second, third, . . . , and m-th rows, for a period of one frame (F). Specifically, as illustrated in the figure, scanning signals Gwr(1), Gwr(2), Gwr(3), . . . , and Gwr(m) are sequentially and exclusively set to an L level for each horizontal scanning period (H) by the scanning line drive circuit 140. In the above explanation, the one frame refers to a period necessary for the micro display device 10 to display one cut (frame) of an image, and when a vertical scanning frequency is 60 Hz, the one frame is a period of 16.7 milliseconds corresponding to one cycle thereof.

Note that, in FIG. 5, vertical scales indicating voltage are not necessarily uniform for each part or each signal.

Operation in a horizontal scanning period (H) is common across each row. In addition, operation of the pixel circuits 110 in the first to n-th columns in a row to be scanned in a horizontal scanning period (H) is common except that a waveform of the control signal Xpwm(j) may vary.

Thus, in the following, the pixel circuit 110 in the i-th row/j-th column will be focused and described.

In the present exemplary embodiment, in a horizontal scanning period (H) in which the scanning line 112 in the i-th row is selected, the scanning signal Gwr(i) is set to the L level, so in the pixel circuit 110 in the i-th row/j-th column, the transistor 122 is turned on. Thus, the gate node of the transistor 121 is brought into a state of being coupled to the data line 114 in the j-th column. Furthermore, in the horizontal scanning period (H), the control signal Gel(i) is set to an H level, so in the pixel circuit 110 in the i-th row/j-th column, as a result of the transistor 124 being turned off, no current flows through the OLED 120 and the OLED 120 is brought into a state of not lighting.

As illustrated in FIG. 5, the horizontal scanning period (H) can be broadly divided, in order, into an initialization period (a), a compensation period (b), a gradation signal generation period (c), and a writing period (d). Note that, the horizontal scanning period (H) is followed by a light emission period.

Thus, each of the periods in the horizontal scanning period (H) and the light emission period will be described separately.

Initialization Period

The initialization period (a) from timing t1 to t2 is a period in which the data line 114 and the gradation signal generation circuit 150*a* are reset to an initial state. The control signals Rst, Clk1, Xgref2, and Xgini are set to the L level in part of the initialization period (a), but the control signals Gcmp(i), XClk1, Xpwm(j), and Xgref3 are at the H level throughout the initialization period (a).

In the initialization period (a), when the control signal Rst is set to the L level, the transistor 153 is turned on and simultaneously, the control signal Clk1 is set to the L level, so the transistor 152 is turned on. Accordingly, both ends of the capacitance element C1 are brought into a state of being coupled to the power supplying line at the voltage Vss, and thus a charge accumulated in the capacitance element C1 is reset. Note that, although not specifically illustrated in FIG. 5, a voltage of the node N is set to Vss.

Further, in the initialization period (a), the control signal Xgini is set to the L level, and as a result of the transistor 161 being turned on, the voltage Vd(j) of the data line 114 is set to the voltage Vdd. In addition, since the control signal Xgref2 is set to the L level, the transistor 163 is turned on, so that the voltage Vv(j) is set to the voltage Vref2.

Compensation Period

The compensation period (b) from timing t2 to t3 is a period for compensating for a threshold of the transistor 121 in the pixel circuit 110. The control signals Gcmp(i), Xpwm (j), and Xgref3 are set to the L level in part of the compensation period (b), but the control signals Rst, xClk1, Clk1, Xgref2, and Xgini are at the H level throughout the compensation period (b).

In the compensation period (b), in a state in which the scanning signal Gwr(i) is at the L level, the control signal Gcmp(i) is set to the L level. Thus, in the pixel circuit 110 in the i-th row/j-th column, the transistor 123 is turned on in a state in which the transistor 122 is on, and thus the transistor 121 is brought into a state in which the gate node and the drain node are coupled, that is, in a diode-coupled state. Accordingly, in the transistor 121, a voltage between the gate and the source converges to a threshold voltage of the transistor 121, and the voltage is retained by the capacitance element Cs.

Additionally, in the diode-coupled state, the gate node and the drain node of the transistor 121 are coupled via the data line 114 in the j-th column, thus the voltage Vd (j) changes from the voltage Vdd in the initialization period (a) to the gate voltage of the transistor 121, specifically, to a gate voltage that causes a voltage between the gate and the source to be the threshold voltage. When the voltage Vd(j) changes, the voltage Vv(j) is also going to change via the capacitance element Ca, but since the control signal Xgref3 is at the L level in the compensation period (b), as a result of the transistor 163 being turned on, the voltage Vv(j) is maintained at the voltage Vref3.

Note that, in the compensation period (b), the control signal Xpwm(j) is set to the L level together with the control signal Xgref3. When the control signal Xpwm(i) is set to the L level, the transistor 159 is turned on, and thus, although not particularly illustrated, the voltage of the node N changes from the voltage Vss in the initial state (a) to the voltage Vref3 that is identical to the voltage Vv(j).

In addition, in the compensation period (b), the control signal Gcmp(i) is set to the L level, so the anode of the OLED 120 is set to the voltage Vorst.

Gradation Signal Generation Period

The gradation signal generation period (c) from timing t3 to t4 is a period for the gradation signal generation circuit 150*a* to generate a gradation signal having a voltage corresponding to a gradation specified by the pixel circuit 110 in the i-th row/j-th column. In the gradation signal generation period (c), the control signals xClk1 and Clk1 are exclusively and alternately set to the L level.

Figure 6:
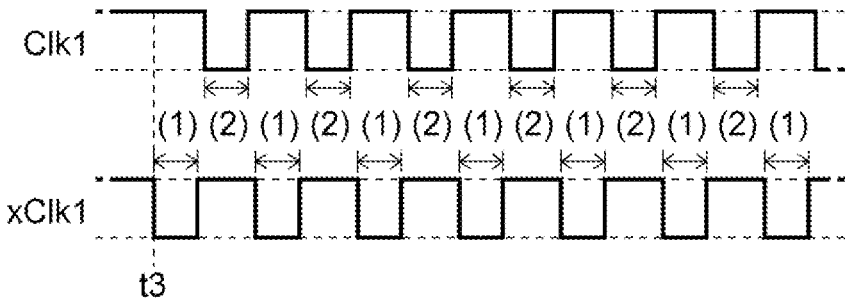
FIG. 6 is a partial enlarged view of the timing chart.

In particular, as illustrated in FIG. 6, a period (1) in which the control signal xClk1 is set to the L level and a period (2) in which the control signal Clk1 is set to the L level are alternately repeated, but a consideration is given such that a period in which both the control signals are set to the H level is sandwiched between the period (1) and the period (2), and the control signals xClk1 and Clk1 are not set to the L level simultaneously. Note that, when viewed from timing t3 from which the gradation signal generation period (c) starts, the control signal xClk1 is set to the L level earlier.

Furthermore, in the gradation signal generation period (c), the control signal Xpwm(j) is set to the L level from timing t3 and for a period corresponding to a gradation of a pixel expressed by the pixel circuit 110 in the i-th row/j-th column, as illustrated in FIG. 5. In particular, a period in which the control signal Xpwm(j) is set to the L level elongates as the OLED 120 of the pixel circuit 110 in the i-th row/j-th column darkens.

For example, when a pixel is made darkest, the control signal Xpwm(j) is set to the L level throughout almost an entirety of a period Tdr_B of the compensation period (b), as indicated by a solid line. When a pixel is made relatively bright, the control signal Xpwm(j) is set to the L level throughout a period Tdr_A that is shorter than the period Tdr_B, as indicated by a dashed line.

Note that, the control signals Gcmp(i), Rst, Xgref2, Xgref3, and Xgini are maintained at the H level throughout an entirety of the gradation signal generation period (c).

In the period (1) in which the control signal xClk1 is at the L level in a state in which the control signal Clk1 is at the H level, the transistor 151 is turned on and the transistor 152 is turned off. Thus, because the one end of the capacitance element C1 is coupled to the power supplying line of the voltage Vdd, a charge is accumulated in the capacitance element C1 in accordance with a capacity thereof and the voltage (Vdd−Vss). Note that, the charge accumulation referred to here is charging the capacitance element C1.

In the period (2) in which the control signal Clk1 is set to the L level, and the control signal xClk1 is set to the H level, the transistor 151 is turned off, and the transistor 152 is turned on, thus, a charge accumulated in the capacitance element C1 is transferred to the node N. Thus, the voltage of the node N rises from the voltage Vref3 in the compensation period (b). Note that, the charge transfer referred to here is discharging from the capacitance element C1.

Again, in the period (1) in which the control signal Clk1 is set to the H level and the control signal xClk1 is set to the L level, a charge is accumulated in the capacitance element C1. Thereafter, in the period (2) in which the control signal Clk1 is set to the L level and the control signal xClk1 is set to the H level, the voltage of the node N rises as a charge accumulated in the capacitance element C1 is transferred to the node N again.

Thereafter, since the charging the capacitance element C1 in the period (1) and the transferring the accumulated charge to the node N in the period (2) are alternately repeated, the voltage of the node N continues to rise.

Note that, in FIG. 5, the voltage Vv(j) rises linearly in the gradation signal generation period (c), but the voltage Vv(j) rises due to repeating the accumulation of charge in the capacitance element C1 and the transfer, a voltage waveform escalates, strictly speaking. However, in practice, respective frequencies of the control signals xClk1 and Clk1 are set to be sufficiently high, so it is not too much to say that the voltage Vv(j) rises linearly.

In the gradation signal generation period (c), the transistor 159 is turned on as far as the control signal Xpwm(j) is at the L level, and thus the voltage of the node N equals the voltage Vv(j). Change (rise) in the voltage Vv(j) is transmitted to the data line 114 in the j-th column, and the like, via the capacitance element Ca. Thus, a change amount of the voltage Vv(j) is compressed in accordance with capacity ratios of the capacitance elements Ca and Cb, to Cs, the voltage Vd(j) is to rise. In other words, the voltage Vd(j) of the data line 114 in the j-th column is to rise as well, as long as the control signal Xpwm(j) is at the L level, along an inclination smaller than that of the voltage Vv(j).

When the control signal Xpwm(j) is inverted to the H level in the gradation signal generation period (c), the transistor 159 switches from on to off, and thus the rise of the voltages Vv(j) and Vd(j) is stopped.

Thus, in the horizontal scanning period (H) in which the scanning line 112 in the i-th row is selected, the voltage Vd(j) immediately before the control signal Xpwm(j) is inverted to the H level is eventually written to the gate node of the transistor 121 in the pixel circuit 110 in the i-th row/j-th column, and retained by the capacitance element Cs.

Here, when the control signal Xpwm(j) is inverted to the H level in the gradation signal generation period (c), the voltage retained by the gate node of the transistor 121 is a voltage obtained by adding a voltage rising for a period in which the control signal Xpwm(j) is at the L level, to a gate voltage that serves as a threshold voltage of the transistor 121 in the compensation period (b). In the horizontal scanning period (H) of the scanning line 112 in the i-th row, the period in which the control signal Xpwm(j) is at the L level is a length corresponding to a gradation expressed by the pixel circuit 110 in the i-th row/j-th column.

Also, in the present exemplary embodiment, in the gradation signal generation period (c), even when the control signal Xpwm(j) is set to the H level, a state in which the control signals xClk1 and Clk1 exclusively and alternately are set to the L level continues, thus the voltage of the node N continues to rise. However, when the control signal Xpwm(j) is set to the H level, the transistor 159 is turned off, so the rise of the voltage of the node N does not affect the voltages Vv(j) and Vd(j).

For example, in order to cause the OLED 120 to emit relatively bright light, after the period Tdr_A and when the control signal Xpwm(j) is inverted to the H level as indicated by a dashed line in FIG. 5, the voltages Vv(j) and Vd(j) stop rising, and subsequently are maintained at respective voltages immediately before the control signal Xpwm(j) is inverted to the H level.

Further, for example, in order to make the OLED 120 darkest, after the period Tdr_B and when the control signal Xpwm(j) is inverted to the H level as indicated by a solid line in FIG. 5, the voltages Vv(j) and Vd(j) stop rising, and subsequently are maintained at respective voltages immediately before the control signal Xpwm(j) is inverted to the H level.

Note that, in the present exemplary embodiment, even after the control signal Xpwm(j) is set to the L level, for example, for the period Tdr_A in the gradation signal generation period (c), and after the control signal Xpwm(j) is inverted to the H level, the control signals xClk1 and Clk1 are alternately switched to the L level, so the voltage of the node N continues to rise.

However, since a voltage signal outputted from the gradation signal generation circuit 150*a*, that is, a voltage signal corresponding to a gradation, is fixed at a point of time at which the control signal Xpwm(j) is inverted to the H level, it may be said that the voltage signal is generated by repeating the charging the capacitance element C1 and the transferring, over a period corresponding to the gradation.

Writing Period

The writing period (d) from timing t4 to end timing of the horizontal scanning period (H) is a period for writing a voltage generated by the gradation signal generation circuit 150*a*, the voltage Vd(j) of the data line 114, to the gate node of the transistor 121 in the pixel circuit 110. However, when the control signal Xpwm(j) is set to the H level, the voltage Vd(j) is fixed to a voltage corresponding to a gradation and reaches the gate node of the transistor 121, and thus the writing period (d) has a nature of an extension period for more sufficiently writing the voltage Vd(j) to the gate node of the transistor 121.

Light Emission Period

After the writing period (d) ends, a light emission period starts. In other words, after the horizontal scanning period (H) in which the scanning line 112 in the i-th row is selected ends, and the light emission period is reached, the control signal Gel(i) is inverted to the L level, and the transistor 124 is turned on, and thus, a current corresponding to the voltage retained by the capacitance element Cs flows through the OLED 120. Thus, the OLED 120 emits light at brightness corresponding to the current.

Note that, although FIG. 5 illustrates an example in which an entirety of a period except the horizontal scanning period (H) in which the scanning line 112 in the i-th row is selected is the light emission period, the light emission period may be part of a period except the horizontal scanning period (H).

In the pixel circuit 110 in the i-th row/j-th column, as described above, the gate voltage of the transistor 121 in the light emission period is the voltage that is made to rise to the voltage such that the voltage between the gate and the source of the transistor 121 is the threshold voltage, for the period corresponding to the gradation expressed by the pixel circuit 110 in the i-th row/j-th column.

Thus, in the present exemplary embodiment, in a state in which the threshold voltage of the transistor 121 is compensated for all the pixel circuits 110 in the m rows and the n columns, the current corresponding to the gradation flows through the OLED 120, variation in brightness is reduced, and as a result, high-quality display is enabled.

Between the period (1) in which the control signal xClk1 is set to the L level, and the period (2) in which the control signal Clk1 is set to the L level, the period in which both the control signals are set to the H level is sandwiched. This is a measure, even when one of the control signals xClk1 and Clk1 is delayed with respect to another for some reason, for suppressing both the control signals from being set to the L level simultaneously. More specifically, when the control signals xClk1 and Clk1 are simultaneously set to the L level, the node N is brought into a state of being coupled to the power supplying line of the voltage Vdd, and thus the voltage of the node N cannot be raised in accordance with the number of times for repeating charge accumulation in the capacitance element C1 and charge transfer. To avoid this, the period in which both the control signals are set to the H level is inserted between the period (1) and the period (2).

In the technique described in Related Art, in particular, in the technique for changing the voltage of the one end of the capacitance element Ca or the data line via the capacitance element, by flowing the constant current generated by the transistor (see, for example, JP-A-2018-4720), the driving capability of the transistor for generating the constant current decreases as the temperature increases, thus the temperature is likely to affect. Thus, in the above-described technique, a temperature sensor for detecting the temperature needs to be separately provided, and the gate voltage of the transistor needs to be controlled so as to keep the current constant in accordance with detected temperature.

Compared to this, in the gradation signal generation circuit 150*a* of the display device 1 according to the present exemplary embodiment, the charge accumulation in the capacitance element C1 and the transfer are performed by repetition of exclusive turning on in the transistors 151 and 152, and thus the temperature hardly affects. Thus, in the gradation signal generation circuit 150*a*, not only accuracy of the voltage Vd(j) supplied to the data line 114 is improved, but also necessity for a temperature sensor, or a circuit for processing detection results of the temperature sensor can be made unnecessary.

Thus, in the present exemplary embodiment, high-quality display can be realized by a simpler configuration.

Note that, in the present exemplary embodiment, a reason for compressing amplitude of the voltage Vd(j) of the data line 114 to be smaller than amplitude of the voltage Vv(j) is to reduce so-called cross talk, or is that a pitch of the pixel circuit 110 to be formed is narrow and a current flowing through the OLED 120 is greatly affected by slight change in the voltage Vd(j), or the like. Accordingly, in a case in which there is a low need to reduce the cross talk, or when a current flowing through the OLED 120 is not greatly affected by slight change in the voltage Vd(j), or the like, a configuration may be adopted in which amplitude of the voltage Vd(j) of the data line 114 is not compressed to be smaller than amplitude of the voltage Vv(j). Even in the configuration in which the compression is not performed, high-quality display can be realized by a simpler configuration because the temperature nevertheless hardly affects.

In the first exemplary embodiment, the control signals xClk1 and Clk1 are alternately switched to the L level over the gradation signal generation period (c), and the control signal Xpwm(j) is set to the L level for the period corresponding to the gradation, so that the voltage of the node N is set corresponding to the gradation. The present disclosure is not limited thereto, and for example, the control signals xClk1 and Clk1 may alternately be set to the L level for a period in which the control signal Xpwm(j) is at the L level. That is, a configuration may be adopted in which the control signals xClk1 and Clk1 are alternately switched to the L level the number of times corresponding to the gradation.

Further, in the first exemplary embodiment, the transistor 153 is included in the gradation signal generation circuit 150*a*, but the transistor 153 need not be provided.

Figure 7:
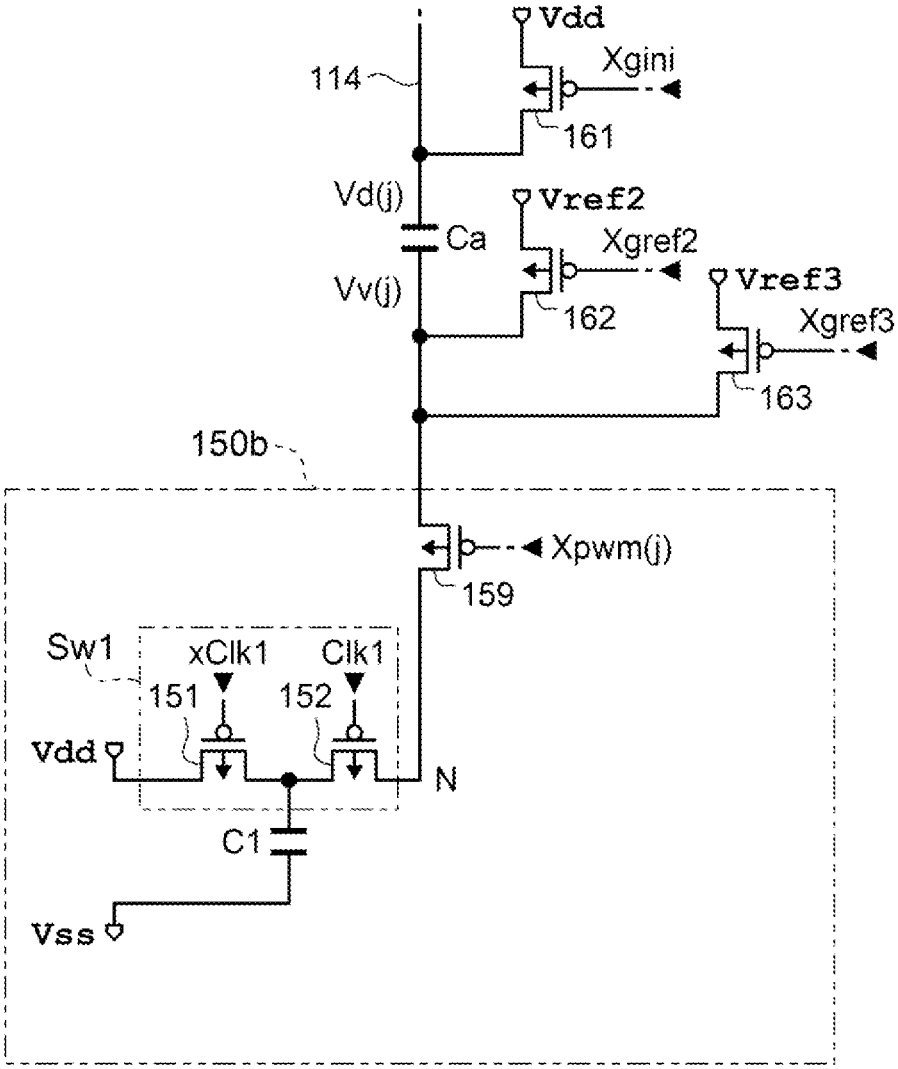
Figure 8:
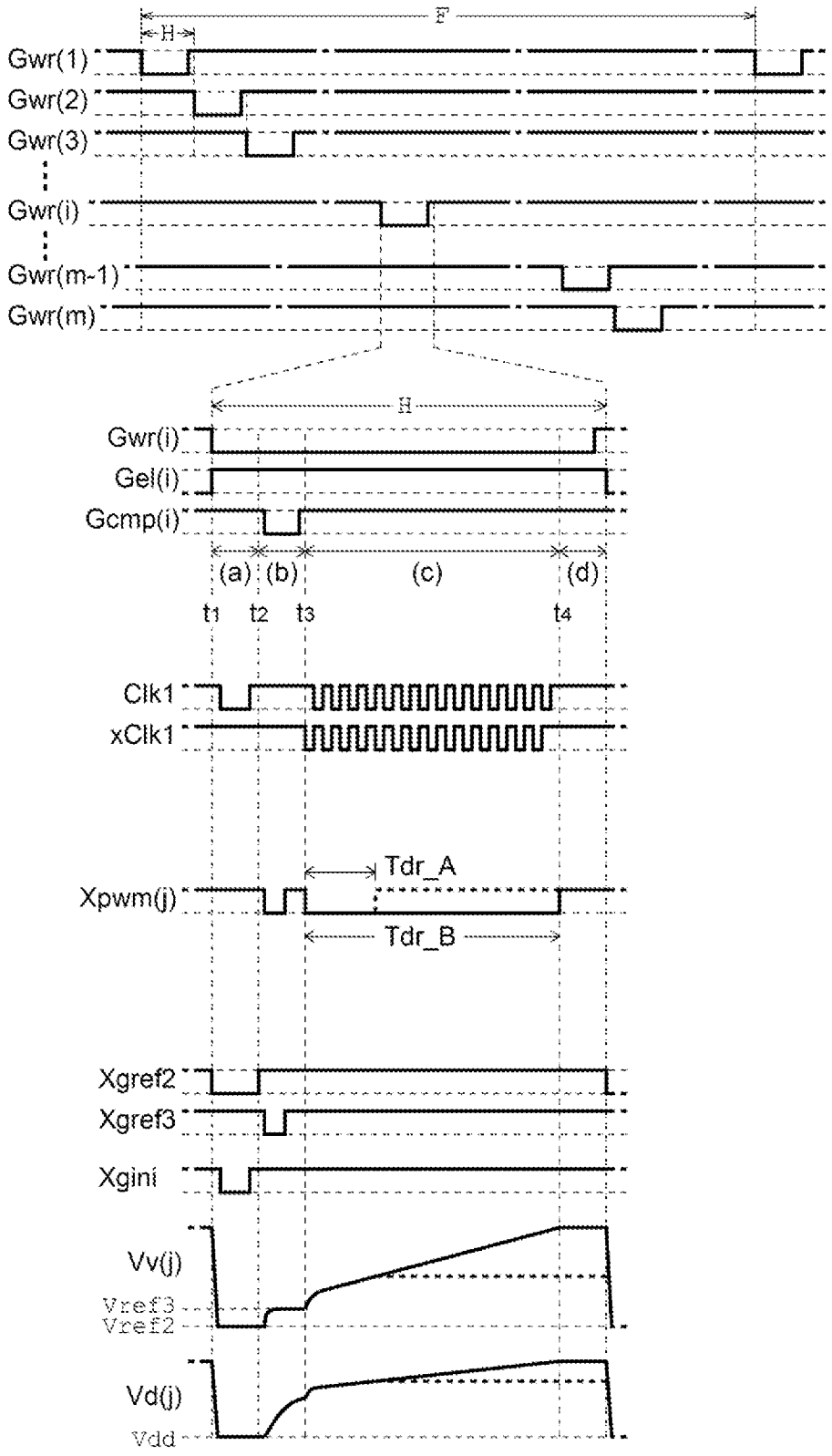
FIG. 8 is a timing chart illustrating operation of the display device.

FIG. 7 is a diagram illustrating a configuration of a gradation signal generation circuit 150*b* not including the transistor 153 in FIG. 4, and FIG. 8 is a timing chart for describing operation thereof.

As illustrated in FIG. 7, a drain node of the transistor 152 is the node N. As illustrated in FIG. 8, when, of the control signals xClk1 and Clk1, the control signal xClk1 is set to the L level earlier, in a gradation signal generation period (c), a charge corresponding to the voltage (Vdd−Vss) and a capacity of the capacitance element C1 is accumulated in the capacitance element C1, thus a previous charge accumulation state does not affect. Thus, it may be said that it is not necessary to necessarily reset the accumulation state of the capacitance element C1 in an initialization period (a).

As described above, according to the gradation signal generation circuit 150*b*, the transistor 153 is not included, so the configuration can be simplified.

Second Exemplary Embodiment

In the first exemplary embodiment described above, in the period (1) in which the control signal xClk1 is set to the L level, a charge is accumulated in the capacitance element C1, and in the period (2) in which the control signal Clk1 is set to the L level, a charge is transferred from the capacitance element C1. Conversely, in the period (1), no charge is transferred from the capacitance element C1, and in the period (2), no charge is accumulated in the capacitance element C1, so it may be said that efficiency of changing the voltage of the node N is low.

Thus, a second exemplary embodiment in which the above problem is improved will be described. Note that, the display device 1 according to the second exemplary embodiment differs from that in the first exemplary embodiment only in a gradation signal generation circuit. Thus, the second exemplary embodiment will be described while focusing on the gradation signal generation circuit.

Figure 9:
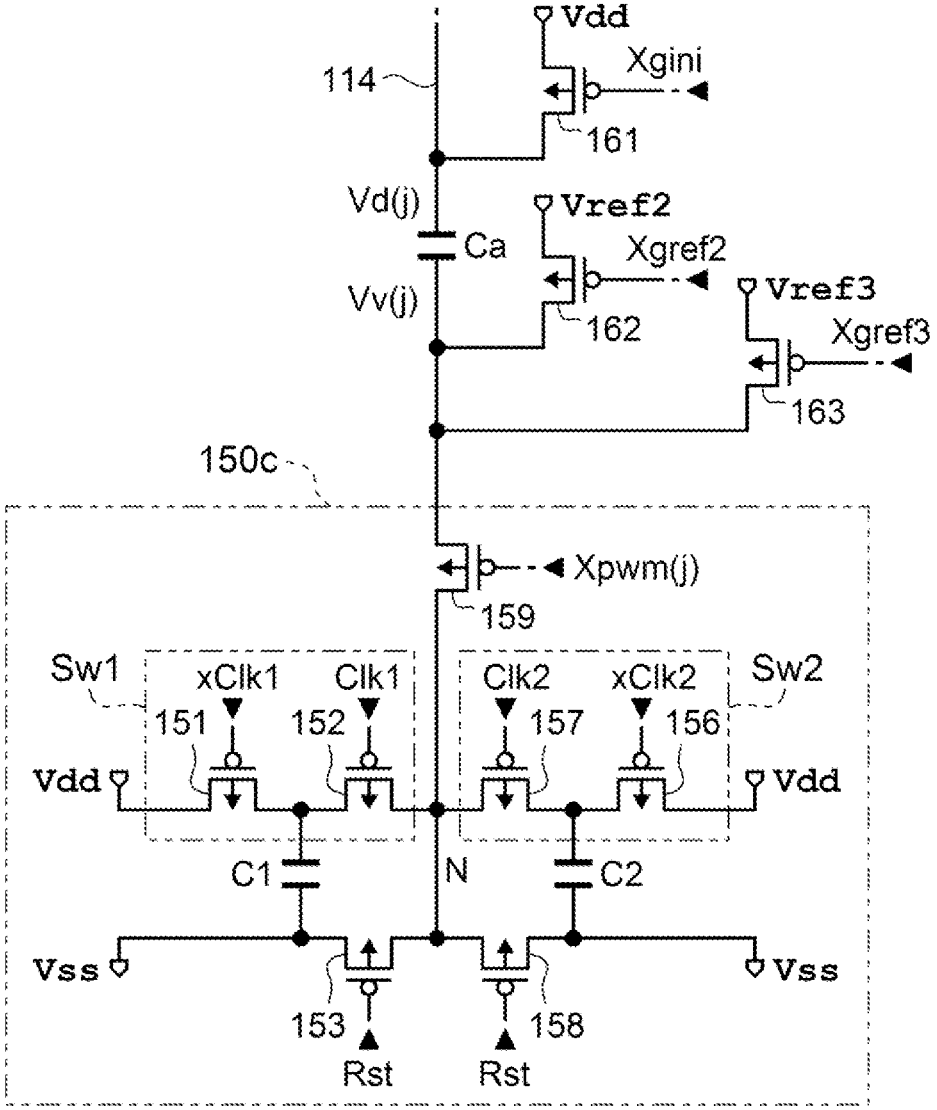
FIG. 9 is a diagram illustrating a configuration of a gradation signal generation circuit and the like of a display device according to a second exemplary embodiment.

FIG. 9 is a circuit diagram illustrating a gradation signal generation circuit 150*c* and the like in the second exemplary embodiment. As illustrated in FIG. 9, the gradation signal generation circuit 150*c* is configured by adding a capacitance element C2, a switching circuit Sw2, and a p-channel type transistor 158 to the gradation signal generation circuit 150*a* illustrated in FIG. 4.

Note that, the switching circuit Sw2 is an example of a second switching circuit, and the capacitance element C2 is an example of a third capacitance element.

In a transistor 156 in the switching circuit Sw2, a control signal xClk2 is supplied to a gate node, a source node is coupled to a power supplying line of the voltage Vdd, and a drain node is coupled to one end of the capacitance element C2 and a source node of a transistor 157.

In the transistor 157, a control signal Clk2 is supplied to a gate node, and a drain node is coupled to the node N.

In the transistor 158, the control signal Rst is supplied to a gate node, a drain node is coupled to another end of the capacitance element C2 and a power supplying line of the voltage Vss, and a source node is coupled to the node N.

Figure 10:
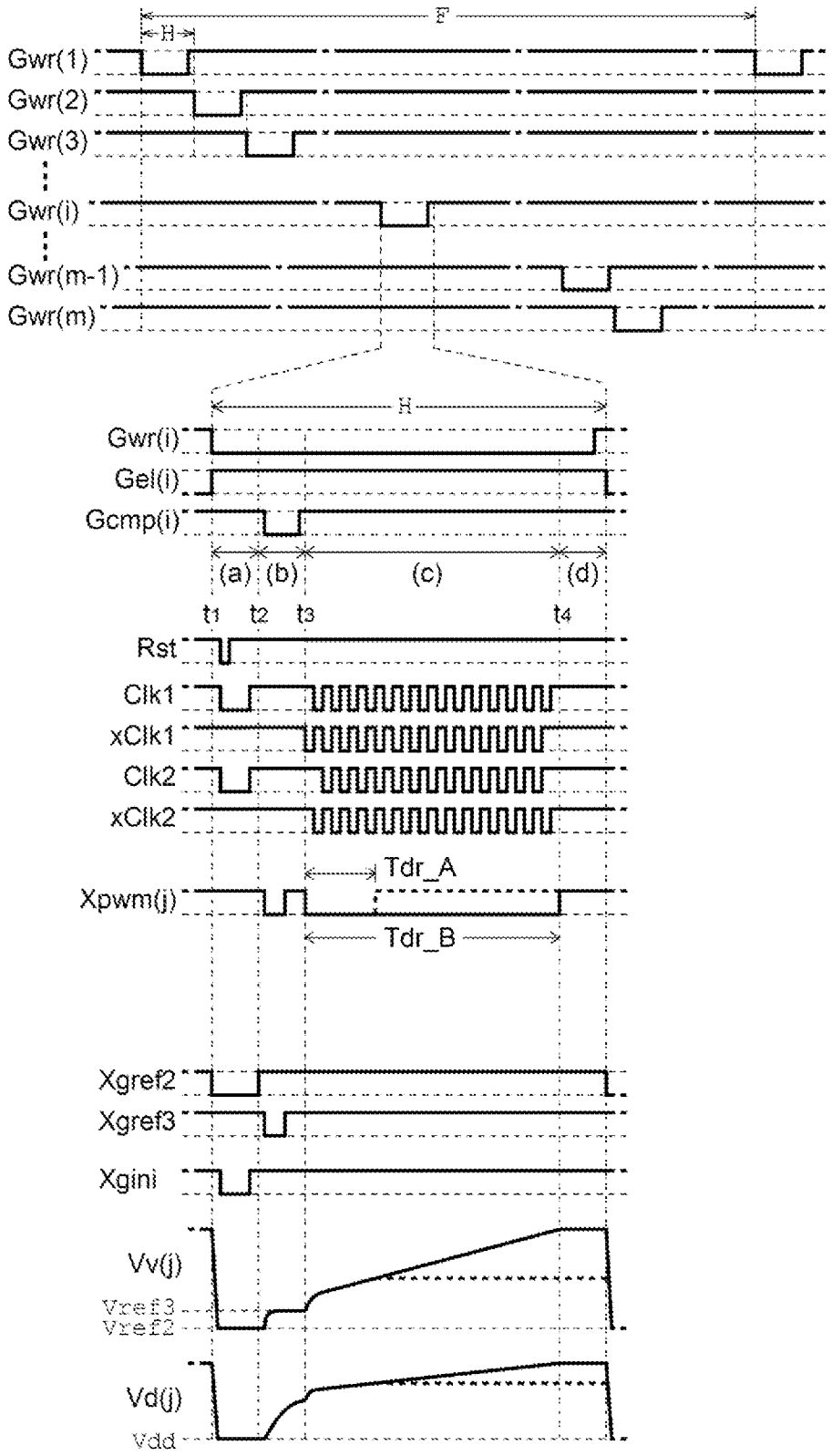
FIG. 10 is a timing chart illustrating operation of the display device.

FIG. 10 is a timing chart illustrating operation of the display device 1 according to the second exemplary embodiment. The second exemplary embodiment differs from the first exemplary embodiment in the operation in the gradation signal generation period (c) in the horizontal scanning period (H).

In the second exemplary embodiment, each of the control signals xClk1 and Clk1 has an identical waveform to that in the first exemplary embodiment. The control signal xClk2 has an identical waveform to that of the control signal Clk1, and the control signal Clk2 has essentially an identical waveform to that of the control signal xClk1, but exceptionally viewed from timing t3 at which the gradation signal generation period (c) starts, the control signal Clk2 is maintained at the H level for a period in which the control signal xClk1 is set to the L level earlier.

Figure 11:
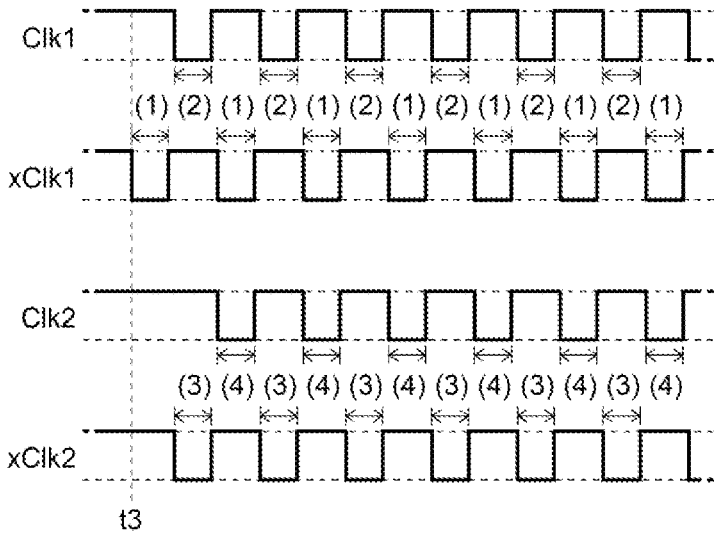
FIG. 11 is a partial enlarged view of the timing chart.

Specifically, as illustrated in FIG. 11, a period (1) in which the control signal xClk1 is set to the L level, and a period (2) in which the control signal Clk1 is set to the L level are alternately repeated, and a period (3) in which the control signal xClk2 is set to the L level, and a period (4) in which the control signal Clk2 is set to the L level are alternately repeated.

Of these, the period (3) is identical to the period (2), and the period (4) is identical to the period (1), but the control signal Clk2 is maintained at the H level in the period (1) in which the control signal xClk1 is set to the L level earlier viewed from timing t3.

Note that, a period in which the control signals xClk1 and Clk1 are both set to the H level is sandwiched between the period (1) and the period (2), and similarly, a period in which the control signals xClk2 and Clk2 are both set to the H level is sandwiched between the period (3) and the period (4).

After timing t3, in the period (1) in which the control signal xClk1 is set to the L level in a state in which the control signals Clk1, xClk2, and Clk2 are set to the H level, the transistor 151 is turned on, and the transistor 152 is turned off, thus in the capacitance element C1, a charge in accordance with a capacity thereof and the voltage (Vdd−Vss) is accumulated.

In the period (2) in which the control signal Clk1 is set to the L level, and the control signal xClk1 is set to the H level, the transistor 151 is turned off, and the transistor 152 is turned on, thus, a charge accumulated in the capacitance element C1 is transferred to the node N. Since the period (2) is also the period (3) in which the control signal xClk2 is set to the L level and the control signal Clk2 is set to the H level, the transistor 156 is turned on and the transistor 157 is turned off, thus in the capacitance element C2, a charge corresponding to a capacity thereof and the voltage (Vdd−Vss) is accumulated.

Again, in the period (1) in which the control signal Clk1 is set to the H level and the control signal xClk1 is set to the L level, a charge is accumulated in the capacitance element C1. Since the period (1) that is repeated is also the period (4), the transistor 156 is turned off and the transistor 157 is turned on, and thus the charge accumulated in the capacitance element C2 is transferred to the node N.

Thereafter, the periods (2) and (3), and the periods (1) and (4) are alternately repeated. As described above, in the second exemplary embodiment, when the charge is accumulated in one of the capacitance elements C1 and C2, the charge is transferred from another of the capacitance elements C1 and C2, and thus the charge accumulation and the transfer are performed in parallel on a time axis. Thus, according to the second exemplary embodiment, it is possible to increase efficiency of voltage generation at the node N.

Note that, in FIG. 10, a rate of rise and change in the voltage Vv(j) in the gradation signal generation period (c), that is an inclination, is expressed to be identical to the inclination in FIG. 5 for convenience, but when the capacity of each of the capacitance elements C1 and C2 in FIG. 9 is identical to the capacity of the capacitance element C1 in FIG. 4, the inclination is actually and approximately doubled.

Alternatively, even when the capacity of each of the capacitance elements C1 and C2 in FIG. 9 is half the capacity of the capacitance element C1 in FIG. 4, the inclination of the voltage Vv (j) in the gradation signal generation period (c) in FIG. 10 can be made equivalent to the inclination in FIG. 5.

Also in the second exemplary embodiment, the transistors 153 and 158 are included in the gradation signal generation circuit 150*c*, but the transistors 153 and 158 need not be provided.

Figure 12:
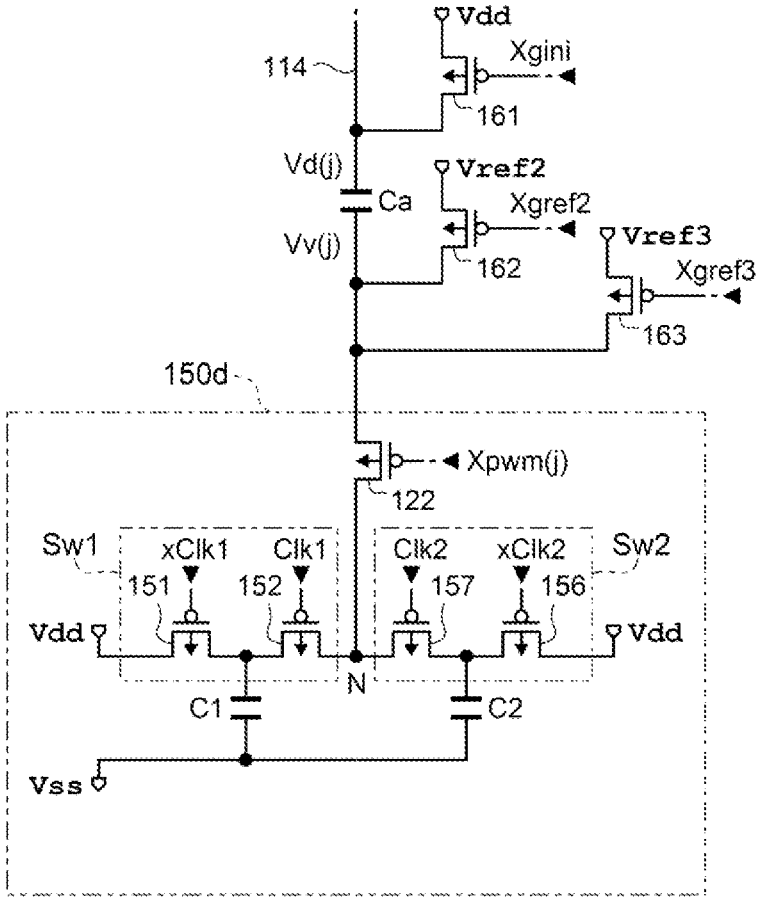
Figure 13:
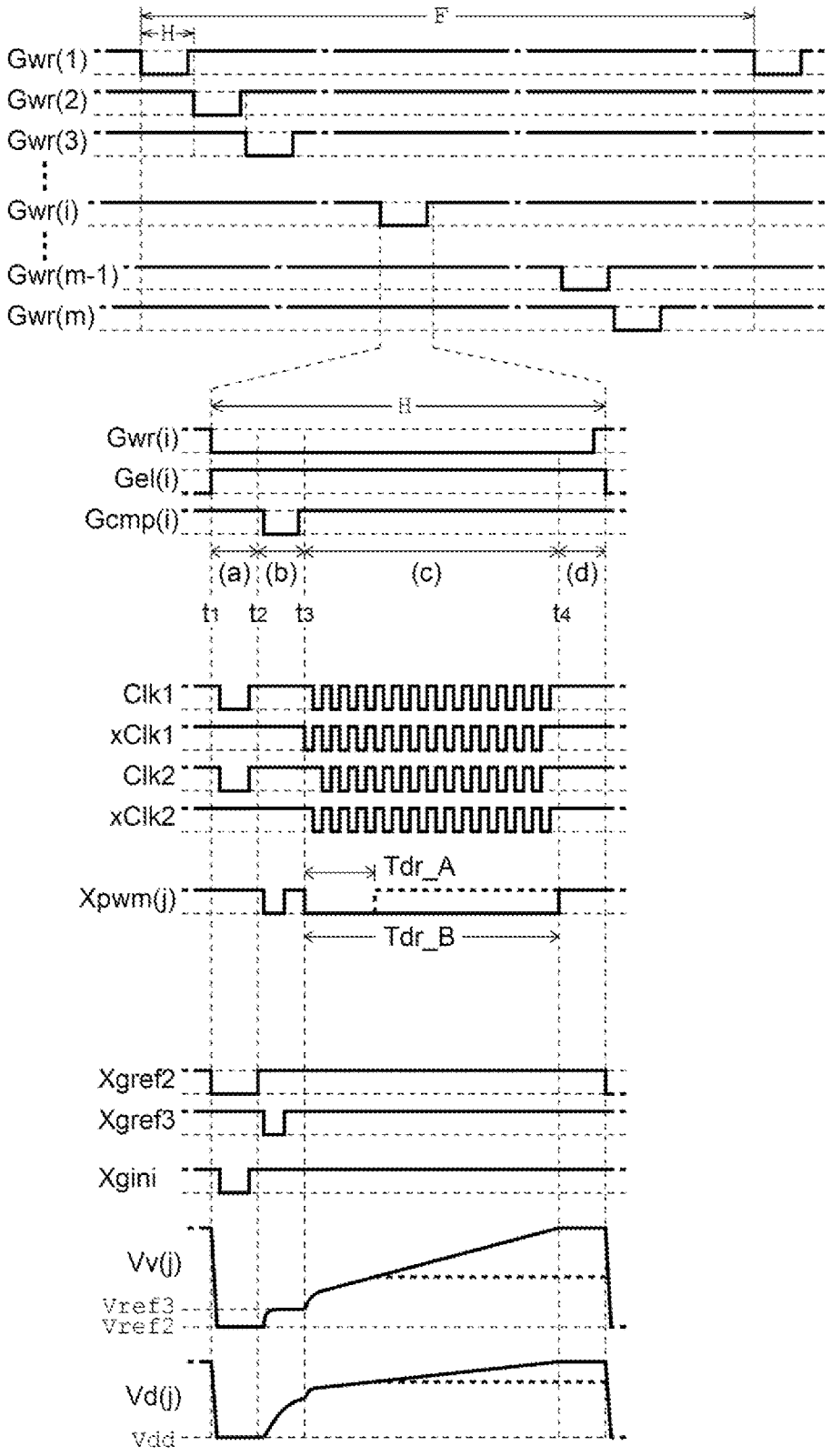
FIG. 13 is a timing chart illustrating operation of the display device.

FIG. 12 is a diagram illustrating a configuration of a gradation signal generation circuit 150*d* not including the transistors 153 and 158 in FIG. 9, and FIG. 13 is a timing chart for describing operation thereof.

As illustrated in FIG. 12, a common drain node for the transistors 152 and 157 is the node N. As illustrated in FIG. 13, when, of the control signals xClk1 and Clk1, the control signal xClk1 is set to the L level earlier, in a gradation signal generation period (c), a charge corresponding to the voltage (Vdd−Vss) and the capacity of the capacitance element C1 is accumulated in the capacitance element C1, and similarly, when, of the control signals xClk2 and Clk2, the control signal xClk2 is set to the L level earlier, a charge corresponding to the voltage (Vdd−Vss) and the capacity of the capacitance element C2 is accumulated in the capacitance element C2, thus a previous charge accumulation state does not affect. Thus, it may be said that it is not necessary to necessarily reset the accumulation state of the capacitance elements C1 and C2 in an initialization period (a).

As described above, according to the gradation signal generation circuit 150*d*, the transistors 153 and 158 are not included, so a configuration can be simplified.

Third Exemplary Embodiment

In the first and second exemplary embodiments described above, there is a concern that the voltage Vd(j) of the data line 114 cannot be applied with high accuracy because the inclination when the voltage Vv(j) rises is constant. Thus, a third exemplary embodiment in which the above problem is improved will be described.

Note that, the display device 1 according to the third exemplary embodiment differs from that in the first exemplary embodiment only in a gradation signal generation circuit. Thus, the third exemplary embodiment will be described while focusing on the gradation signal generation circuit as well.

Figure 14:
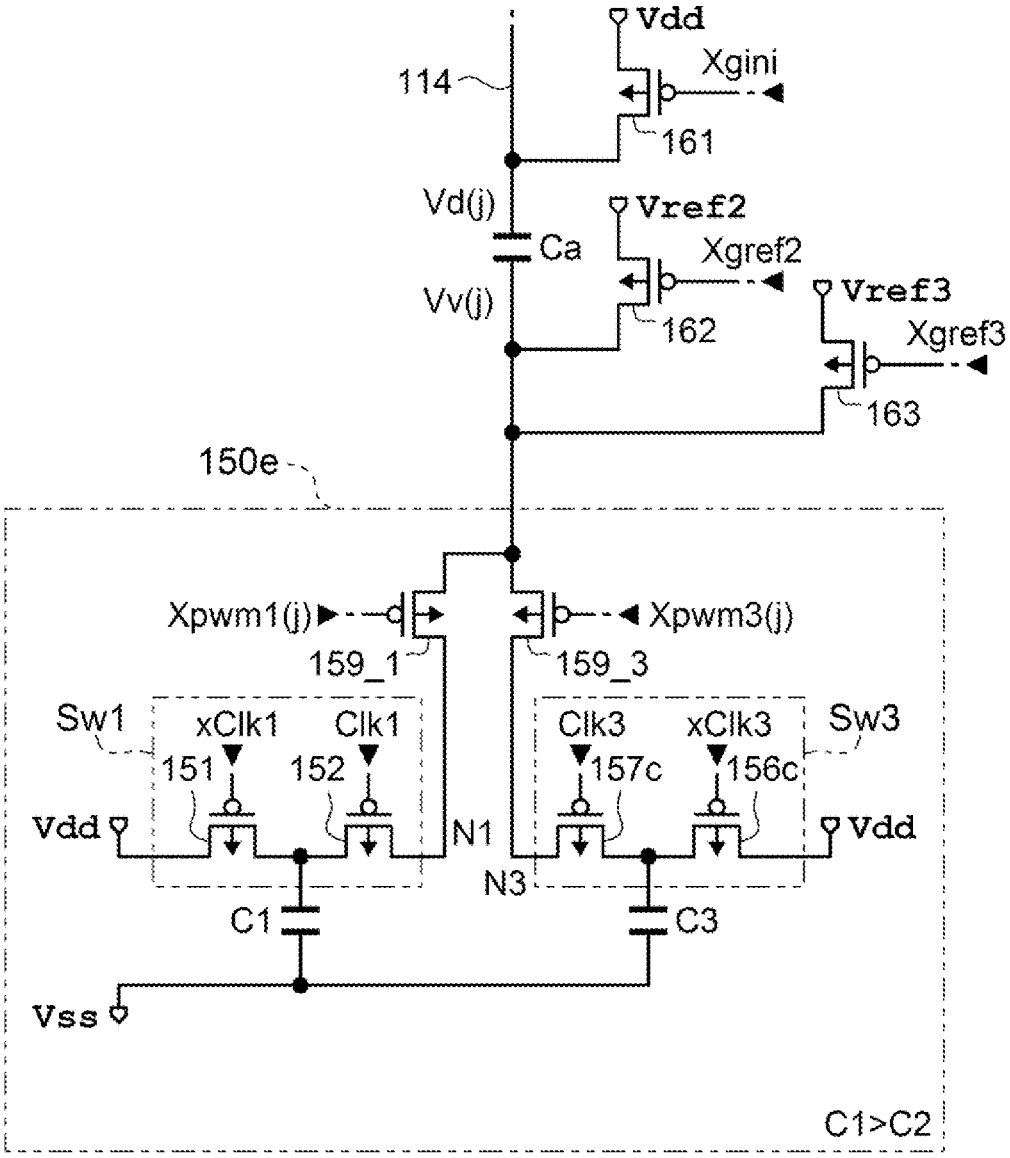
FIG. 14 is a diagram illustrating a configuration of a gradation signal generation circuit and the like of a display device according to a third exemplary embodiment.
Figure 15:
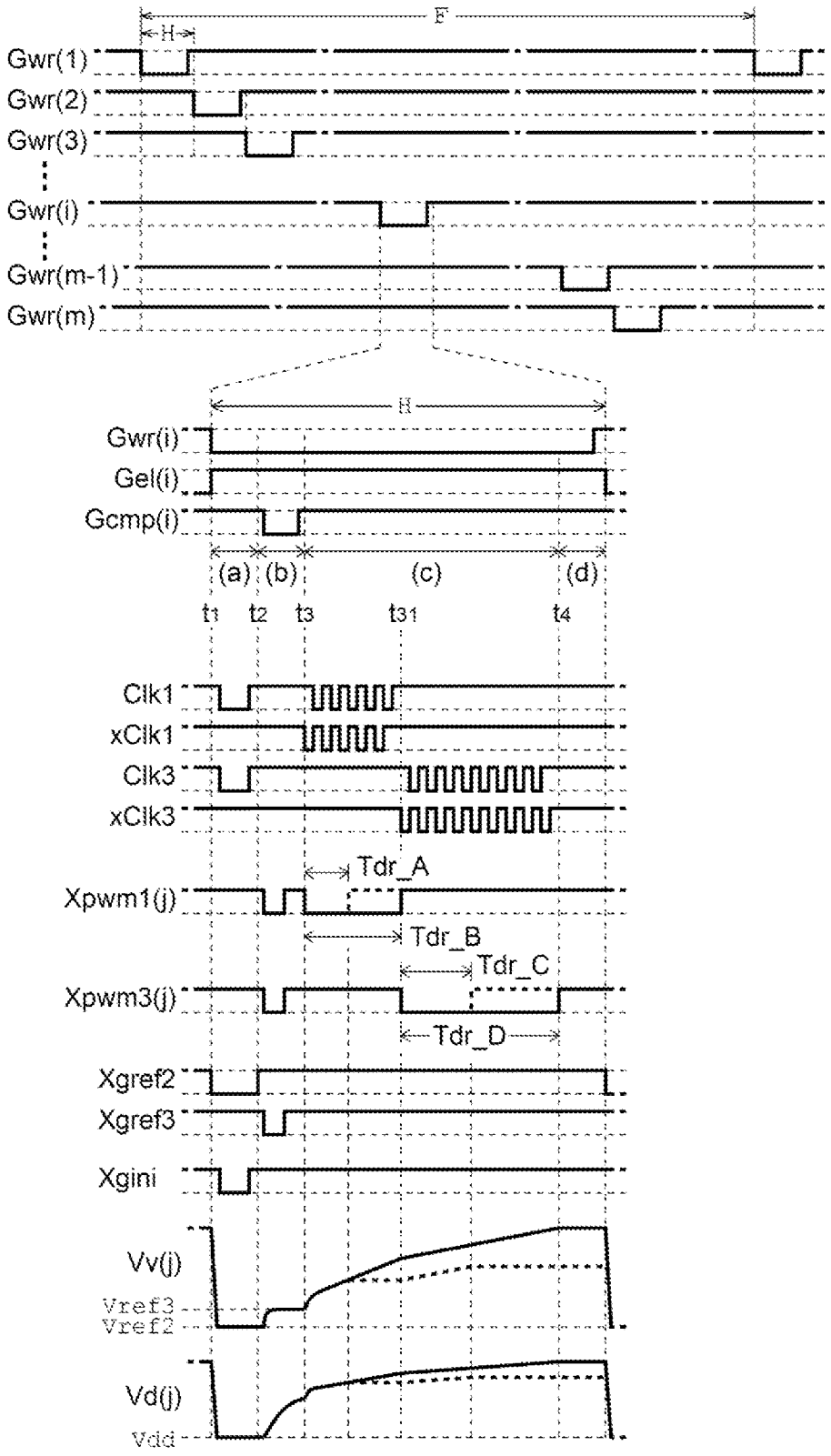
FIG. 15 is a timing chart illustrating operation of the display device.

FIG. 14 is a circuit diagram illustrating a gradation signal generation circuit 150*e* and the like in the third exemplary embodiment, and FIG. 15 is a timing chart for describing operation thereof.

As illustrated in FIG. 14, the gradation signal generation circuit 150*e* is configured by adding a capacitance element C3, a switching circuit Sw3, and a p-channel type transistor 159_3 to the gradation signal generation circuit 150*b* illustrated in FIG. 7.

Note that, the switching circuit Sw3 is an example of a third switching circuit, and the capacitance element C3 is an example of a fourth capacitance element. In addition, a symbol of the transistor 159 in FIG. 7 is changed to 159_1 for convenience in FIG. 14, and a control signal supplied to the gate node of the transistor 159_1 is denoted as Xpwm1 (*j*).

The switching circuit Sw3 has p-channel type transistors 156*c* and 157*c*. In the transistor 156*c* in the switching circuit Sw3, a control signal xClk3 is supplied to a gate node, a source node is coupled to a power supplying line of the voltage Vdd, and a drain node is coupled to one end of the capacitance element C3 and a source node of the transistor 157*c*.

In the transistor 157*c*, a control signal Clk3 is supplied to a gate node, and a drain node is coupled to a source node of the transistor 159_3.

A control signal Xpwm3(*j*) is supplied to a gate node of the transistor 159_3. Note that, a drain node of the transistor 159_1 and a drain node of the transistor 159_3 are coupled to one end of the capacitance element Ca.

Further, another end of the capacitance element C3 is coupled to a power supplying line of the voltage Vss. In addition, a capacity of the capacitance element C3 is smaller than a capacity of the capacitance element C1. For convenience, a drain node of the transistor 152 is denoted as a node N1, and the drain node of the transistor 157*c* is denoted as a node N3.

In the third exemplary embodiment, the control signals Xpwm1(*j*) and Xpwm3(*j*) are supplied by the control circuit 130 corresponding to the j-th column. In other words, although not particularly illustrated, for the first to n-th columns, the control signals Xpwm1(1) to Xpwm1(*n*), and Xpwm3(1) to Xpwm3(*n*) are generated by the control circuit 130 that are specific to the respective columns.

Here, in the j-th column, of the final voltage Vv(j) in a gradation signal generation period (c), a control signal for performing coarse adjustment is Xpwm1(*j*), and a control signal for performing fine adjustment is Xpwm3(*j*). For example, a case will be described as an example in which, a gradation is specified, for example, by 8 bits (256 gradations), specifically, a darkest state is specified by the 8 bits that are expressed as decimal "0", and a brightest state is specified by the 8 bits that are expressed as decimal "255".

For the control signal Xpwm1(*j*), as illustrated in FIG. 15, in a period from timing t3 to timing t31 in the middle of a gradation signal generation period (c), with timing t3 being a starting point, a period in which the L level is set becomes shorter, as a gradation specified by upper 4 bits becomes brighter, for example. Note that, in FIG. 15, the period Tdr_B denoted by a solid line indicates a maximum period in which the control signal Xpwm1(*j*) is set to the L level, and the period Tdr_A denoted by a dashed line is an example in which the control signal Xpwm1(*j*) is set to the L level in a period shorter than the maximum period.

Further, for the control signal Xpwm3(*j*), in a period from timing t31 to timing t4, with timing t31 being a starting point, a period in which the L level is set becomes shorter, as a gradation specified by lower 4 bits becomes brighter, for example. Note that, in FIG. 15, the period Tdr_D denoted by a solid line indicates a maximum period in which the control signal Xpwm3(*j*) is set to the L level, and the period Tdr_C denoted by a dashed line is an example in which the control signal Xpwm3(*j*) is set to the L level in a period shorter than the maximum period.

In the third exemplary embodiment, the control signal xClk1 is set to the L level earlier in a period from timing t3 to timing t31, of the gradation signal generation period (c), and subsequently, the control signals xClk1 and Clk1 are set to the L level alternately. Further, the control signal xClk3 is set to the L level earlier in the period from timing t31 to timing t4, of the gradation signal generation period (c), and subsequently, the control signals xClk3 and Clk3 are set to the L level alternately.

Note that, a point that the control signals xClk1 and Clk1 are not simultaneously set to the L level, and a point that the control signals xClk3 and Clk3 are not simultaneously set to the L level, are similar to those in the first exemplary embodiment.

In the third exemplary embodiment, in the period from timing t3 to timing t31, of the gradation signal generation period (c), an inclination relatively increases when a voltage of the node N1 rises due to accumulation of a charge in the capacitance element C1 having large capacity, and transfer. On the other hand, in the period from timing t31 to timing t4, an inclination relatively decreases when a voltage of the node N3 rises due to accumulation of a charge in the capacitance element C3 having small capacity, and transfer.

Thus, in the third exemplary embodiment, the voltage Vv(j) rises relatively and greatly for a period in which the control signal Xpwm1(*j*) is at the L level, and in the period from timing t31 to timing t4, the voltage Vv(j) rises relatively and slightly for a period in which the control signal Xpwm3(*j*) is at the L level. Thus, according to the third exemplary embodiment, the voltage Vv(j) is subjected to the coarse adjustment with the control signal Xpwm1(*j*), and is subjected to the fine adjustment with the control signal Xpwm3(*j*), thus, accuracy of the voltage Vd(j) of the data line 114 transmitted via the capacitance element Ca can be increased.

Application Example and Modification Example

The first, second, and third exemplary embodiments (hereinafter referred to as the exemplary embodiments and the like) described above can be applied or modified as follows, for example. Furthermore, one or more of arbitrarily selected application and modification aspects described below can be appropriately combined with.

In the exemplary embodiments and the like, for example, a configuration is adopted in which the operation of charging by coupling the one end of the capacitance element C1 to the power supplying line of the voltage Vdd, and the operation of transferring the charge to the node N by coupling the other end of the capacitance element C1 to the node N with the one end of the capacitance element C1 being disconnected from the above power supplying line are repeated, to raise the voltage of the node N.

In addition to this configuration, the voltage of node N can be raised by various configurations.

Figure 16:
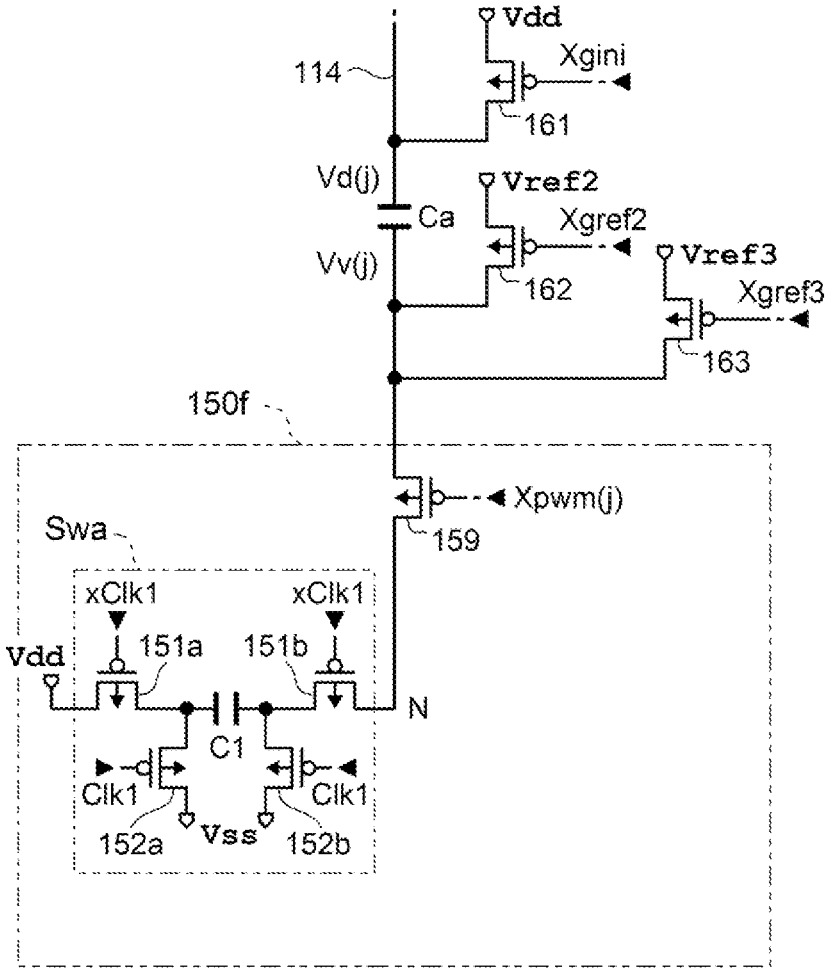

FIG. 16 is a diagram illustrating a gradation signal generation circuit 150*f* in which another configuration is adopted for raising the voltage of the node N. The configuration illustrated in this figure is an example in which a switching circuit Swa includes transistors 151*a*, 151*b*, 152*a*, and 152*b*. According to this example, in an initialization period (a), a charge accumulation state of the capacitance element Ca is reset by the L level of the control signal Clk1. Note that, the reset here means discharging to the capacitance element C1.

Thereafter, in a gradation signal generation period (d), the control signal xClk1 is set to the L level, and the transistors 151*a* and 151*b* are turned on, so a charge is transferred to the node N via the capacitance element C1. Note that, the charge transfer referred to here is charging the capacitance element C1.

Next, the control signal Clk1 is set to the L level, and the transistors 152*a* and 152*b* are turned on, so an accumulation state of the capacitance element C1 is reset. Thus, with the configuration in which the charge transfer and the reset are repeated in this way, as well, the voltage of the node N can be raised.

Note that, in the other configuration, although not illustrated in particular, two sets of the configurations illustrated in FIG. 16 may be prepared and, while a charge is transferred in one set, an accumulation state of a capacitance element may be reset in another set, as in the second exemplary embodiment. Additionally, as in the third exemplary embodiment, a configuration may be adopted in which the two capacitance elements with different capacities are used, a rate at which a voltage is raised is increased by using the capacitance element having a large capacity, and accuracy of a voltage to be raised is improved by using the capacitance element having a small capacity.

In the exemplary embodiments and the like, the transistors 121 to 125 in the pixel circuit 110 are of a p-channel type, but the transistors may be of an n-channel type, or may be of a complementary type in which a p-channel type and an n-channel type are combined. Furthermore, the number of the transistors constituting the pixel circuit 110 and a coupling relationship may be changed.

Similarly, in the exemplary embodiments and the like, the transistors 151 and 152 (156 and 157) in the switching circuit Sw1 (Sw2) are of a p-channel type, but may be of an n-channel type, or of a complementary type.

Note that, a source node and a drain node in each transistor may be switched as appropriate in accordance with a channel type or a potential relationship.

Further, in addition to RGB, another color or multiple colors may be added in a case of color display of one dot. For example, one dot may be configured by four colors with yellow (Y) added to enlarge a reproducible color gamut, or one dot may be configured by four colors with white (W) added to enhance brightness.

A transistor or the like of the micro display 10 may be formed, not at a silicon substrate, but at other semiconductor substrates, or may be formed at a glass substrate. In the exemplary embodiments and the like, the OLED, which is the light-emitting device is illustrated as a display element, but, for example, an inorganic light emitting diode or Light Emitting Diode (LED) may be used.

Electronic Apparatus

Next, an electronic apparatus to which the micro display 10 according to the exemplary embodiments and the like is applied will be described. The micro display 10 is suitable for application with a small pixel and high definition display. Thus, a head-mounted display (HMD) will be described as an example of the electronic apparatus.

Figure 17:
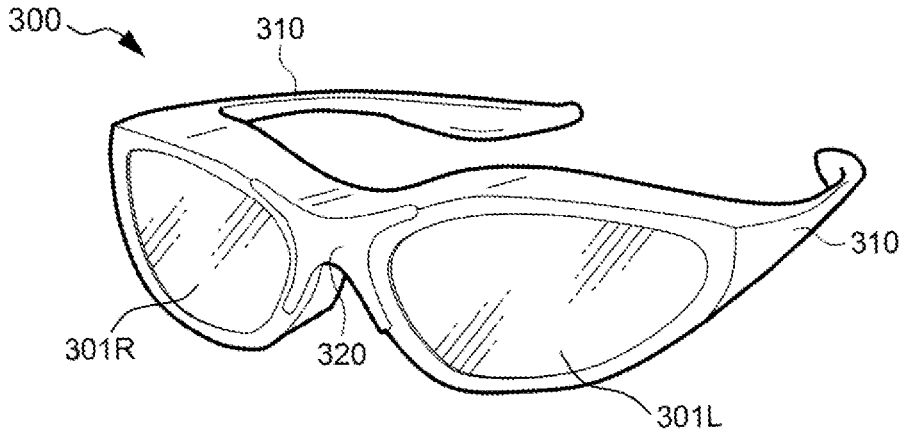
Figure 18:
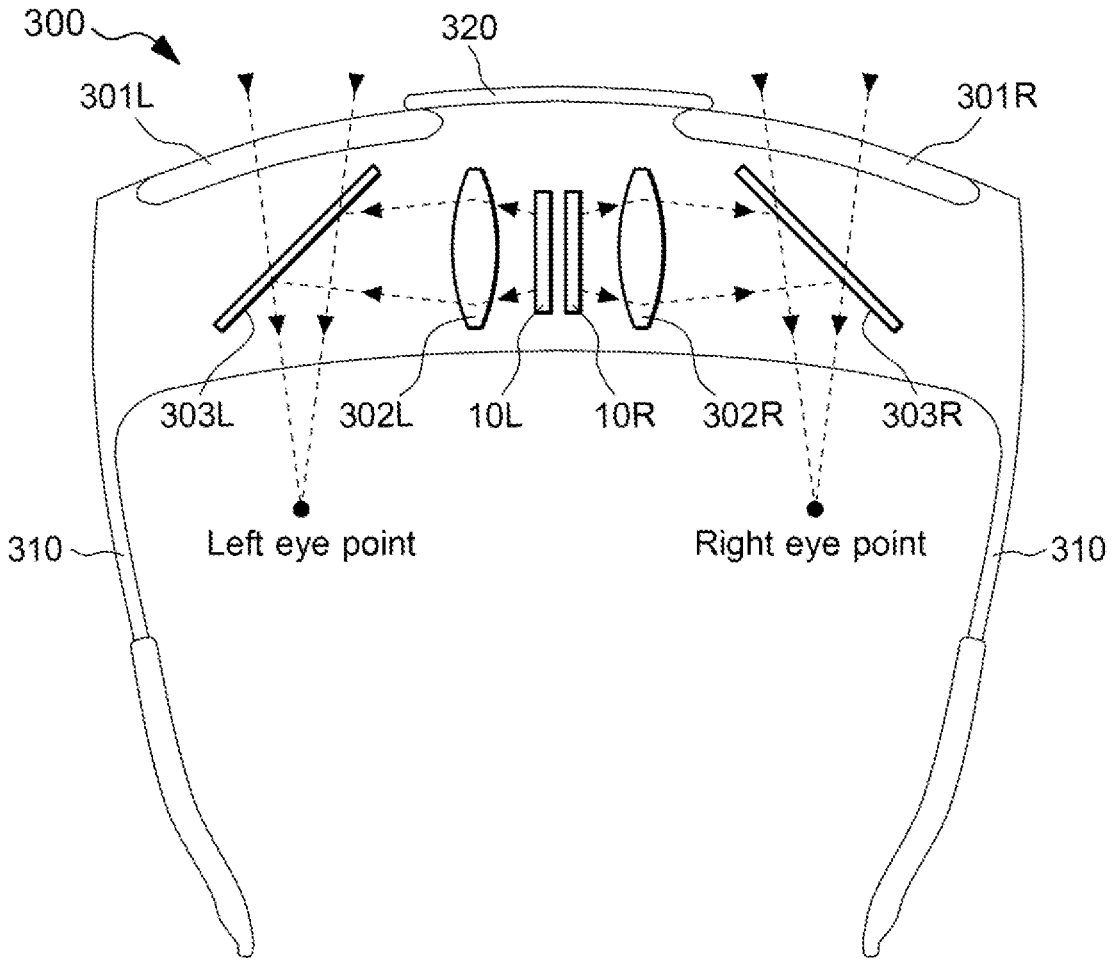
FIG. 18 is a diagram illustrating an optical configuration of the HMD.

FIG. 17 is a diagram illustrating appearance of the head-mounted display, and FIG. 18 is a diagram illustrating an optical configuration of the head-mounted display.

As illustrated in FIG. 17, a head-mounted display 300 includes, in terms of appearance, temples 310, abridge 320, and lenses 301L and 301R, as with typical eye glasses. In addition, as illustrated in FIG. 18, the head-mounted display 300 is provided with a micro display 10L for a left eye and a micro display 10R for a right eye in the vicinity of the bridge 320 and on the back side (the lower side in the figure) of the lenses 301L and 301R.

An image display surface of the micro display 10L is disposed to be on the left side in FIG. 18. According to this configuration, a display image by the micro display 10L is outputted via an optical lens 302L in a 9-o'clock direction in the figure. A half mirror 303L reflects the display image by the micro display 10L in a 6-o'clock direction, while the half mirror 303L transmits light entering in a 12-o'clock direction.

An image display surface of the micro display 10R is disposed on the right side opposite to the micro display 10L. According to this configuration, a display image by the micro display 10R is outputted via an optical lens 302R in a 3-o'clock direction in the figure. A half mirror 303R reflects the display image by the micro display 10R in the 6-o'clock direction, while the half the mirror 303R transmits light entering in the 12-o'clock direction.

In this configuration, a wearer of the head-mounted display 300 can observe the display images by the micro displays 10L and 10R in a see-through state in which the display images by the electro-optical devices 10L and 10R overlap with the outside.

In addition, in the head-mounted display 300, of images for both eyes with parallax, an image for a left eye is displayed on the micro display 10L, and an image for a right eye is displayed on the micro display 10R, and thus, it is possible to cause a wearer to sense the displayed images as an image displayed having a depth or a three dimensional effect.

Note that, in addition to the head mount display 300, the micro display 10 can be applied to an electronic viewing finder in a video camera, a lens-exchangeable digital camera, or the like.

What is claimed is:

1. A display device, comprising:

a pixel circuit;

a driving circuit configured to drive a data line coupled to the pixel circuit; and a first capacitance element provided between the data line and the driving circuit, wherein the driving circuit includes a second capacitance element, and a first switching circuit configured to alternately repeat charging and discharging of the second capacitance element, and is configured to control the charging and the discharging based on a gradation specified by the pixel circuit to output a voltage signal in accordance with the gradation.

2. The display device according to claim 1, wherein the driving circuit is configured to repeat the charging and the discharging for a period corresponding the gradation to generate the voltage signal.

3. The display device according to claim 1, wherein the driving circuit is configured to repeat the charging and the discharging the number of times corresponding to the gradation to generate the voltage signal.

4. The display device according to claim 1, wherein the driving circuit includes a third capacitance element, and a second switching circuit configured to alternately repeat charging and discharging of the third capacitance element, and the second switching circuit discharges the third capacitance element in a period in which the first switching circuit charges the second capacitance element, and the second switching circuit charges the third capacitance element in a period in which the first switching circuit discharges the second capacitance element.

5. The display device according to claim 1, wherein the driving circuit includes a fourth capacitance element different from the first capacitance element in capacity, and a third switching circuit configured to alternately repeat charging and discharging of the fourth capacitance element.

6. A display device, comprising:

a pixel circuit;

a data line coupled to the pixel circuit;

a driving circuit configured to drive the data line; and a first capacitance element having a first end coupled to the data line and a second end coupled to the driving circuit, wherein the driving circuit includes a second capacitance element, and a first switching circuit configured to alternately repeat charging and discharging of the second capacitance element, and is configured to control the charging and the discharging based on a gradation specified by the pixel circuit to output a voltage signal in accordance with the gradation.

7. An electronic apparatus comprising:

the display device according to claim 1.

* * * * *